US010892564B1

(12) United States Patent
Huang et al.

(10) Patent No.: US 10,892,564 B1
(45) Date of Patent: Jan. 12, 2021

(54) INTEGRATION MODULE OF MILLIMETER-WAVE AND NON-MILLIMETER-WAVE ANTENNAS

(71) Applicants: ETHETA COMMUNICATION TECHNOLOGY (SHENZHEN) CO.,LTD, Shenzhen (CN); EAST CHINA RESEARCH INSTITUTE OF MICROELECTRONICS, Hefei (CN)

(72) Inventors: Huan-Chu Huang, Taoyuan (TW); Junyong Liu, Hefei (CN); Hong Lin, Shenzhen (CN); Hao Sun, Hefei (CN); Zhixing Qi, Shenzhen (CN); Minhui Zeng, Hefei (CN); Yanchao Zhou, Shenzhen (CN); Jingwei Li, Hefei (CN); Tao Ma, Hefei (CN)

( * ) Notice: Subject to any disclaimer, the term of this patent is extended or adjusted under 35 U.S.C. 154(b) by 0 days.

(21) Appl. No.: 16/885,717

(22) Filed: May 28, 2020

(30) Foreign Application Priority Data

Apr. 1, 2020 (CN) ..... 2020 1 02522497

(51) Int. Cl.

| | |
|---|---|
| ***H01Q 1/24*** | (2006.01) |
| ***H01Q 21/28*** | (2006.01) |
| ***H01Q 21/06*** | (2006.01) |
| ***H01Q 9/04*** | (2006.01) |
| ***H01Q 21/08*** | (2006.01) |

(52) U.S. Cl.
CPC ..... *H01Q 21/28* (2013.01); *H01Q 1/243* (2013.01); *H01Q 9/0428* (2013.01); *H01Q 21/065* (2013.01); *H01Q 21/08* (2013.01)

(58) Field of Classification Search
CPC ..... H01Q 21/28; H01Q 9/0428; H01Q 21/08; H01Q 21/065; H01Q 1/243
See application file for complete search history.

(56) References Cited

U.S. PATENT DOCUMENTS

| | | | | |
|---|---|---|---|---|
| 2010/0099367 | A1* | 4/2010 | Shamim | G01T 1/026 455/95 |
| 2019/0123441 | A1* | 4/2019 | Sudo | H01Q 3/2635 |
| 2019/0379119 | A1* | 12/2019 | He | H01Q 25/00 |
| 2020/0052367 | A1* | 2/2020 | Zhu | H01Q 1/243 |

* cited by examiner

*Primary Examiner* — Dameon E Levi
*Assistant Examiner* — David E Lotter
(74) *Attorney, Agent, or Firm* — HYIP

(57) ABSTRACT

The present invention discloses an integration module of millimeter-wave and non-millimeter-wave antennas, comprising a module carrier, one or more millimeter-wave antennas, one or more non-millimeter-wave antennas, and a radio frequency integrated circuit; the radio frequency integrated circuit is electrically connected to the millimeter-wave antenna(s); the radio frequency integrated circuit and the non-millimeter-wave antenna(s) are set in the same plane as or a space non-parallel with that of the module carrier. With the present invention, the height space on the side of a mobile communication device can be fully used, so that it is not necessary to occupy a large amount of horizontal area, thereby reducing the requirements of the antenna module for the overall size of the mobile communication device, and thus reducing cost and enhancing product competitiveness.

17 Claims, 17 Drawing Sheets

Drawings

INTEGRATION MODULE OF MILLIMETER-WAVE AND NON-MILLIMETER-WAVE ANTENNAS

FIELD OF THE INVENTION

The invention relates to the field of antenna technology, and in particular to an integration module of millimeter-wave and non-millimeter-wave antennas.

BACKGROUND OF THE INVENTION

With the arrival of the 5G age, due to the requirements for higher-order multi-input and multi-output (MIMO) communications, the requirements for coverage of more new frequency bands, and even the addition of the millimeter wave bands, the more number of antennas (comprising millimeter-wave and non-millimeter-wave antennas) is required. Nevertheless, it results in higher difficulty with the antenna designs in the case that the space of a whole device cannot be significantly increased. Furthermore, the size of the whole device will be even increased due to the insufficiently compact antenna arrangements or designs, resulting in a decline in product competitiveness. The 5G frequency bands are divided into millimeter wave bands and non-millimeter wave bands. At present, the mainstream antenna design scheme for non-millimeter wave bands is to have separate antenna, and the mainstream implementation types comprise stamped iron sheet, flexible printed circuits (FPC), laser direct structuring (LDS), and printed direct structuring (PDS), etc.; and the current mainstream antenna design scheme for the millimeter wave bands is the integrated antenna-in-package (AiP), that is, an antenna (or antennas) and a chip (especially a radio frequency integrated circuit (RFIC)) are integrated into a packaged antenna module. As mentioned above, the number of antennas has increased significantly in the 5G age, and thus the 5G device requires multiple separate 5G non-millimeter-wave antennas and several 5G millimeter-wave antenna modules (if the device can support millimeter wave band communications).

Since the space of the whole device cannot be increased significantly, and there are communication requirements for more 5G (millimeter-wave and non-millimeter-wave) antennas to be accommodated, it results in higher difficulty with antenna designs or higher costs. Furthermore, the size of the whole device will be even increased due to the insufficiently compact antenna arrangements or designs, resulting in a decline in product competitiveness.

Therefore, it is necessary to propose a new technical solution to solve the problem in the prior art.

SUMMARY OF THE INVENTION

Aiming at the problem in the prior art, the present invention provides an integration module of millimeter-wave and non-millimeter-wave antennas, a specific solution of which is as follows:

comprising a module carrier, one or more millimeter-wave antennas, one or more non-millimeter-wave antennas, and a radio frequency integrated circuit; the radio frequency integrated circuit is electrically connected to the millimeter-wave antenna(s); the radio frequency integrated circuit and the non-millimeter-wave antenna(s) are set in the same plane as or in a space non-parallel with that of the module carrier.

In the present invention, the radio frequency integrated circuit and the non-millimeter-wave antenna(s) are set in the same plane as or in a space non-parallel with that of the module carrier. Especially for the non-parallel space setting, the height space on the side of a mobile phone can be fully used, so that it is not necessary to occupy a large horizontal area, a more compact antenna design is achieved without the increasement of the size and the cost of the whole device, and the product competitiveness is improved accordingly.

Preferably, each millimeter-wave antenna can be in the form of any one of single linear polarization, dual linear polarization, single circular polarization, or dual circular polarization antenna working in a single band or multiple bands.

Preferably, the number of the millimeter-wave antenna(s) is multiple, forming one or more millimeter-wave antenna arrays; and each of said millimeter-wave antenna array is any one of a linear array, a square array, a rectangular array, a triangular array, a circular array, and a non-equidistant array.

Preferably, the number of the millimeter-wave antenna array is one, and the millimeter-wave antenna array is a one-dimensional linear array, and the size of each millimeter-wave antenna unit is less than or equal to 2 equivalent guided wavelengths at its the lowest operating frequency; the spacing between two adjacent millimeter-wave antennas is less than or equal to 2 free-space wavelengths at its lowest operating frequency.

Preferably, each non-millimeter-wave antenna is in the form of any one of a monopole antenna, a dipole antenna, patch antenna, stacked patch antenna, inverted F antenna (IFA), planar inverted F antenna (PIFA), Yagi-Uda antenna, slot antenna, magnetic-electric dipole antenna, horn antenna, loop antenna, grid antenna, cavity-backed antenna and leaky-wave antenna.

Preferably, the number of non-millimeter-wave antenna(s) is two, and the total length of each non-millimeter-wave antenna 3*a* is ¼ of the equivalent guided wavelength corresponding to its operating frequency; the spacing between two non-millimeter-wave antennas 3*a* is greater than 0.01 free-space wavelength at their lowest operating frequency.

Preferably, the integration module of millimeter-wave and non-millimeter-wave antennas further comprises other chips, which are selected from any one or more of a power management chip, an arithmetic processing chip, and a data storage chip.

Preferably, the module carrier is provided with a ground layer, and the non-millimeter-wave antenna(s) is connected to the ground layer.

Preferably, the process for achieving the millimeter-wave and the non-millimeter-wave antennas may be silver paste tracing, laser direct structuring (LDS, i.e., laser direct forming), printed direct structuring (PDS, i.e., printing direct forming), FPC, stamping metal sheet.

Preferably, the shape of the module carrier can be any one of square, rectangle, triangle, trapezoid, C-shape, E-shape, F-shape, L-shape, T-shape, V-shape, U-shape, W-shape, X-shape, Y-shape, Z-shape, "concave" shape, "convex" shape, "mouth (□)" shape, "one square encircled by another bigger one (回)" shape, round, ellipse and arc.

Preferably, the material of the module carrier is any one of low-temperature co-fired ceramic (LTCC), high-temperature co-fired ceramic (HTCC), ceramic, printed circuit board (PCB), flexible printed circuit (FPC), modified PI (MPI), liquid crystal polymer (LCP) and fluorine-containing material.

The integration module of millimeter-wave and non-millimeter-wave antennas provided by the present invention has the following beneficial effects:

it can be applied to a mobile communication device, the height space on the side of the device can be fully used, so that it is not necessary to occupy a large amount of horizontal area, thereby reducing the requirements of the antenna module for the overall size of the mobile communication device, and thus reducing cost and enhancing product competitiveness.

DETAILED DESCRIPTION OF THE EXAMPLES

The present invention will be further described below in conjunction with the drawings and specific examples.

Example One

Figure 1:
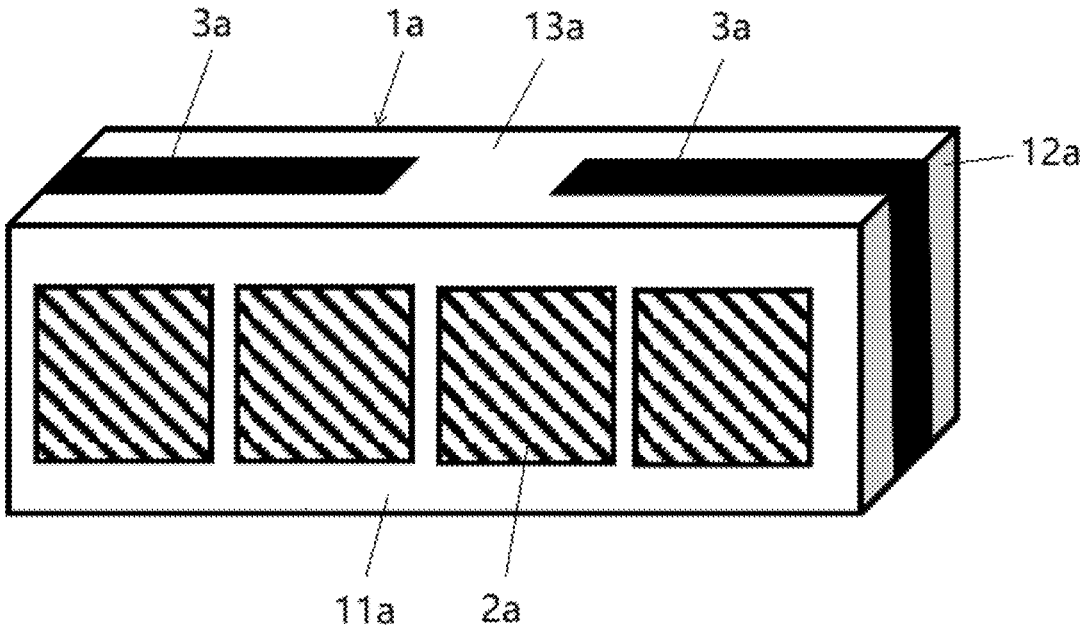
FIG. 1 is a three-dimensional structural schematic diagram of Example One of the present invention.
Figure 2:
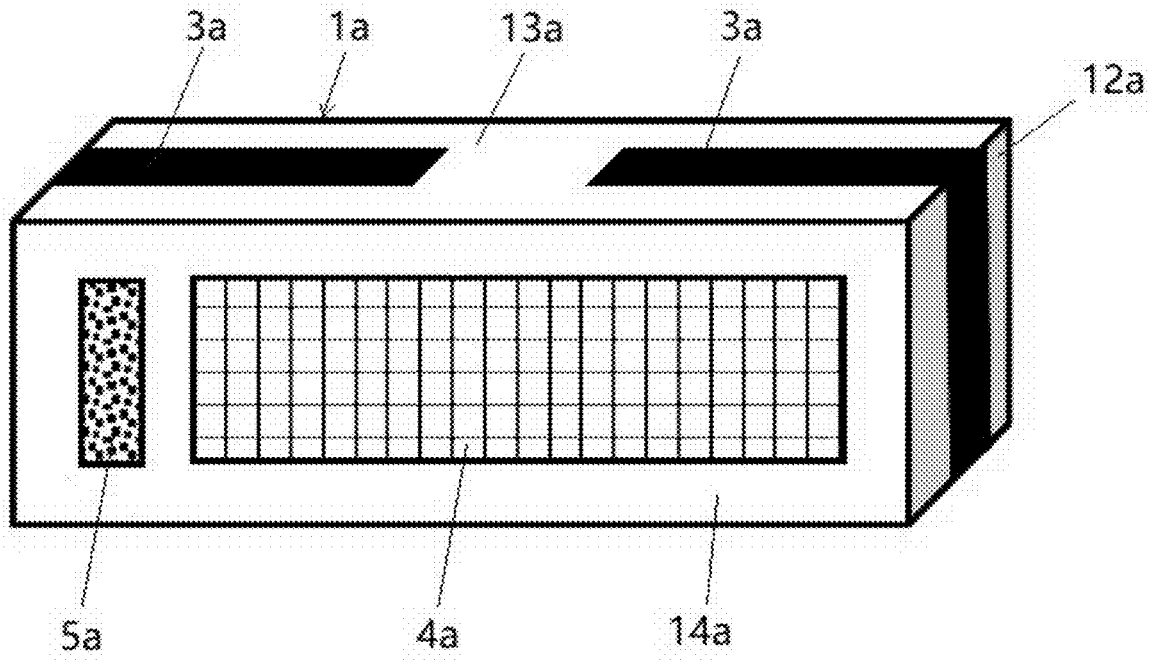
FIG. 2 is a three-dimensional structural schematic diagram of Example One of the present invention at another perspective.

Referring to FIGS. 1 and 2, this example provides an integration module of millimeter-wave and non-millimeter-wave antennas, comprising a module carrier 1*a*, a millimeter-wave antenna array 2*a*, two non-millimeter-wave antennas 3*a*, a radio frequency integrated circuit 4*a*, and a connecting base 5*a*. The module carrier 1*a* is a rectangular parallelepiped. The millimeter-wave antenna array 2*a* is provided on the front long side vertical face 11*a* of the module carrier 1*a*. The two non-millimeter-wave antennas 3*a* are respectively arranged from the two short side vertical faces 12*a* of the module carrier 1*a* to the upper top face 13*a* of the module carrier 1*a*. The radio frequency integrated circuit 4*a* and the connecting base 5*a* are provided on the rear long side vertical face 14*a* of the module carrier 1*a*.

The millimeter-wave antenna array 2*a* is formed by four millimeter-wave antennas in a one-dimensional linear array, wherein the four millimeter-wave antennas are in the form of any one of single linear polarization, dual linear polarization, single circular polarization, or dual circular polarization antennas working in a single band or multiple bands. The size of each millimeter-wave antenna unit is less than or equal to 2 equivalent guided wave wavelengths at its lowest operating frequency, and the spacing between two adjacent millimeter-wave antennas is less than or equal to 2 free-space wavelengths at its lowest operating frequency; the two non-millimeter-wave antennas 3*a* are monopole antennas, and the total length of each non-millimeter-wave antenna 3*a* is preferably the ¼ of the equivalent guided wave wavelength corresponding to its operating frequency, the spacing between the two non-millimeter-wave antennas 3*a* is greater than 0.01 free-space wavelength at their lowest operating frequency.

Figure 3:
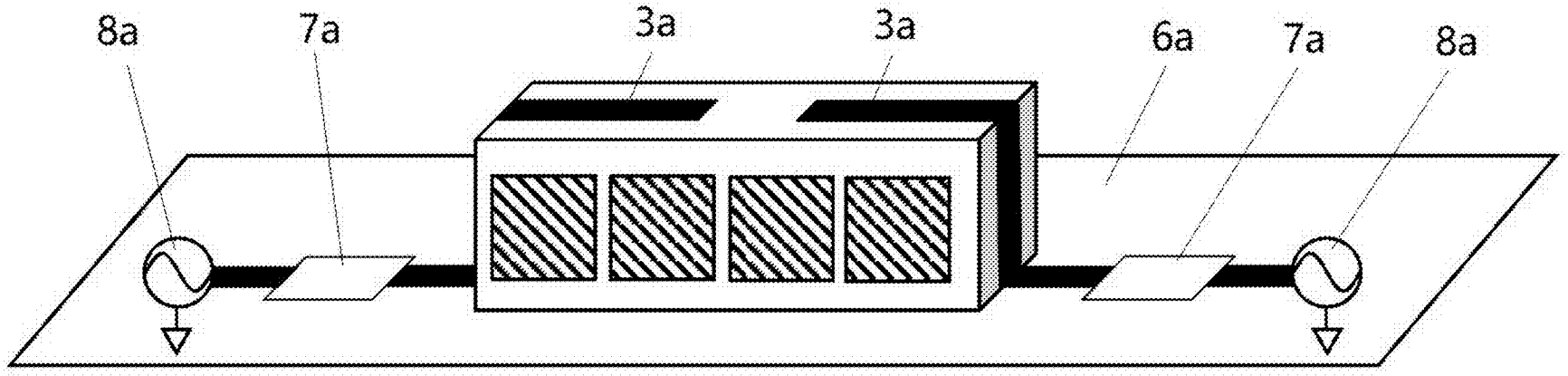
FIG. 3 is a structural schematic diagram of a system setting of Example One of the present invention.
Figure 4:
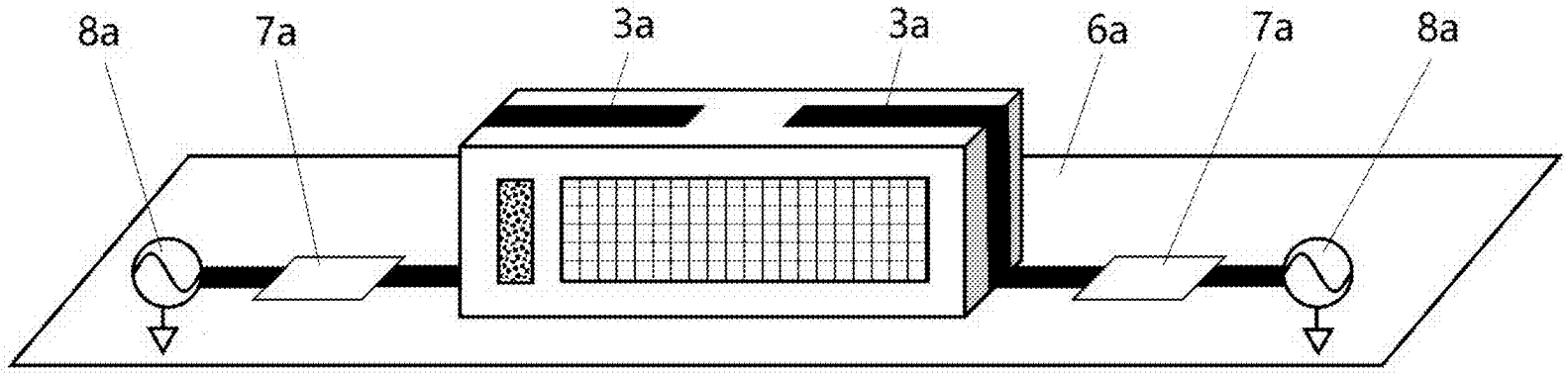
FIG. 4 is a view of FIG. 3 at another perspective.

Referring to FIGS. 3 and 4, when applied, the integration module of millimeter-wave and non-millimeter-wave antennas is placed on a PCB 6*a*, and the two non-millimeter-wave antennas 3*a* are respectively connected to a non-millimeter-wave antenna matching network 7*a* and a non-millimeter-wave antenna feeding source 8*a* on the left and right sides of the integration module of millimeter-wave and non-millimeter-wave antennas.

In this example, the radio frequency integrated circuit 4*a* and the non-millimeter-wave antennas 3*a* are in non-parallel space. In the following other examples, they are in non-parallel space or in the same plane, which can be specifically set according to the shape of the module carrier 1*a*. From the description of the Example One, those skilled in the art can know how to set them in the same plane or in non-parallel space, which will not be described in detail in the following examples.

The integration module of millimeter-wave and non-millimeter-wave antennas provided in this example is applied to a mobile communication device and has the following effect:

the height space on the side of the mobile phone can be fully used, so that it is not necessary to occupy a large amount of horizontal area, thereby reducing the requirements for the overall size of the mobile communication device, and reducing the requirements of the antenna module for the overall size of the mobile communication device, and thus reducing cost and enhancing product competitiveness.

Example Two

Figure 5:
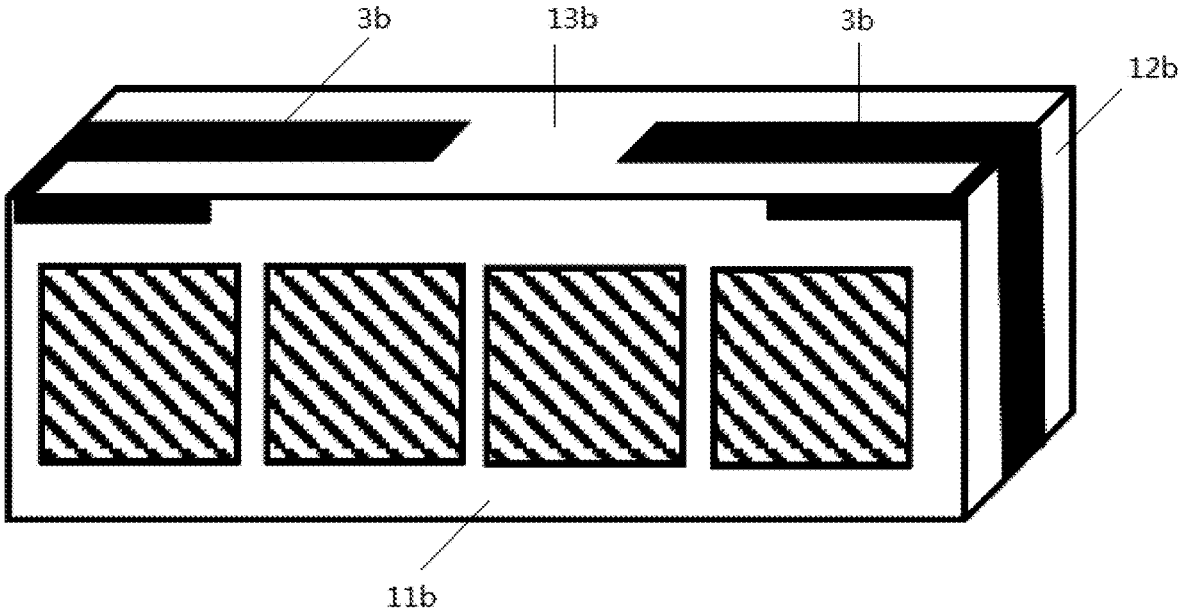
FIG. 5 is a three-dimensional structural schematic diagram of Example Two of the present invention.
Figure 6:
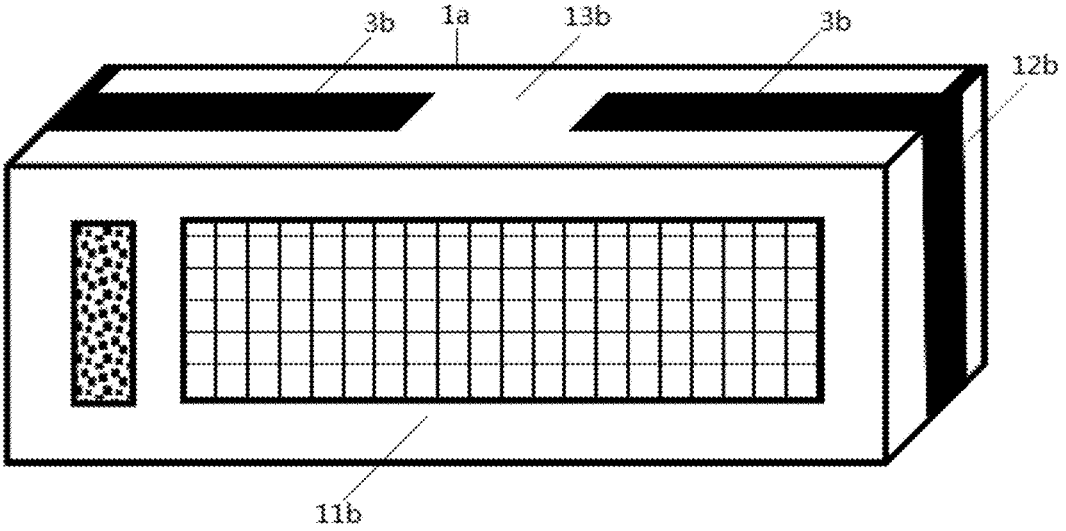
FIG. 6 is a three-dimensional structural schematic diagram of Example Two of the present invention at another perspective.

Referring to FIGS. 5 and 6, this example provides an integration module of millimeter-wave and non-millimeter-wave antennas, the composition and structural configuration of which are basically the same as those in Example One, except that the traces of the two non-millimeter-wave antennas 3*b* included in this integration module comprise the front long side vertical face 11*b* of the module carrier 1*a* in addition to the two short side vertical faces 12*b* and the upper top face 13*b*, the total length of each branch of each of the non-millimeter-wave antennas 3*b* is ¼ of the equivalent guided wave wavelength corresponding to their respective operating frequency, and the spacing between the two non-millimeter-wave antennas 3*b* is greater than 0.01 free-space wavelength at their lowest operating frequency.

The integration module of millimeter-wave and non-millimeter-wave antennas provided in this example has the same technical effect as that in Example One.

Example Three

Figure 7:
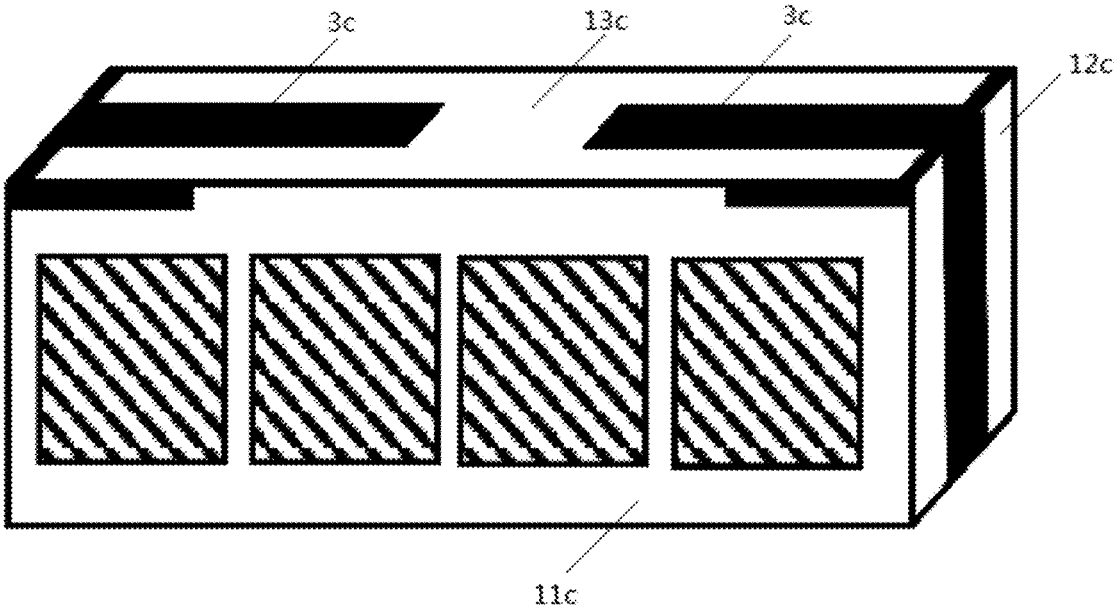
FIG. 7 is a three-dimensional structural schematic diagram of Example Three of the present invention.
Figure 8:
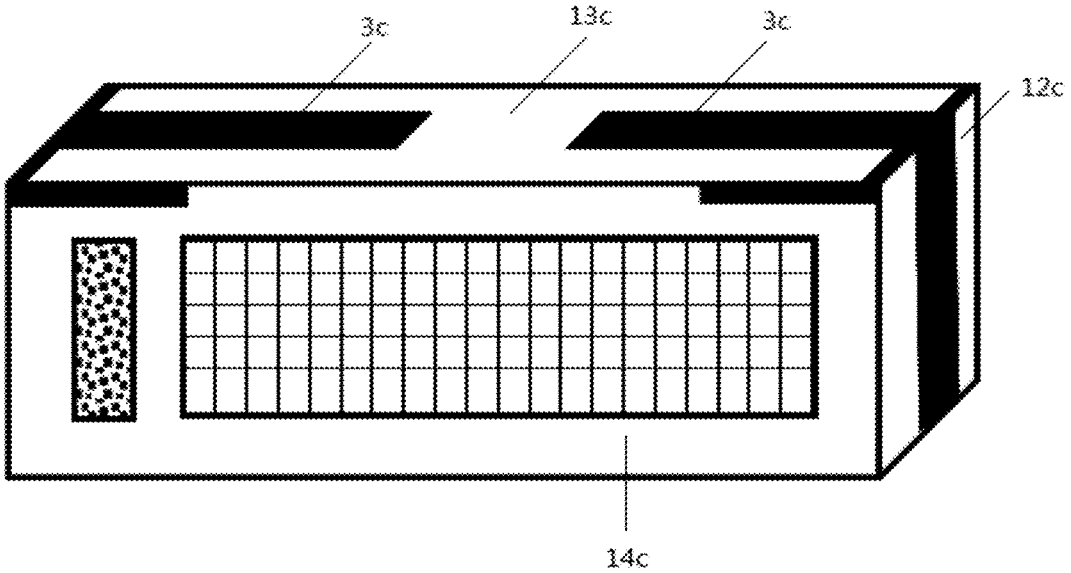
FIG. 8 is a three-dimensional structural schematic diagram of Example Three of the present invention at another perspective.

Referring to FIGS. 7 and 8, this example provides an integration module of millimeter-wave and non-millimeter-wave antennas, the composition and structural configuration of which are basically the same as those in Example Two, except that the traces of the two non-millimeter-wave antennas 3*c* included in this integration module comprise the rear long side vertical face 14*c* in addition to the two short side vertical faces 12*b*, the upper top face 13*b* and the front long side vertical face 11*c*.

The integration module of millimeter-wave and non-millimeter-wave antennas provided in this example has the same technical effect as those in Example One and Example Two.

Example Four

Figure 9:
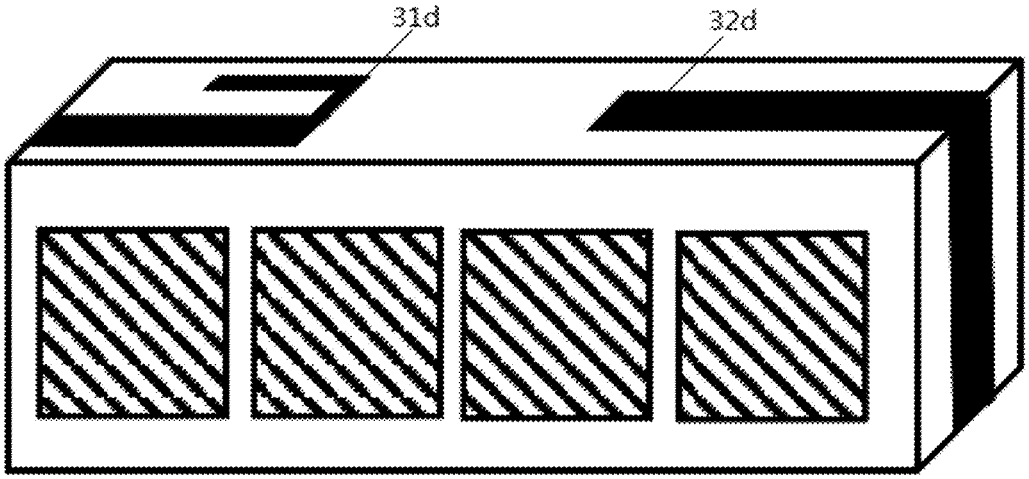
FIG. 9 is a three-dimensional structural schematic diagram of Example Four of the present invention.
Figure 10:
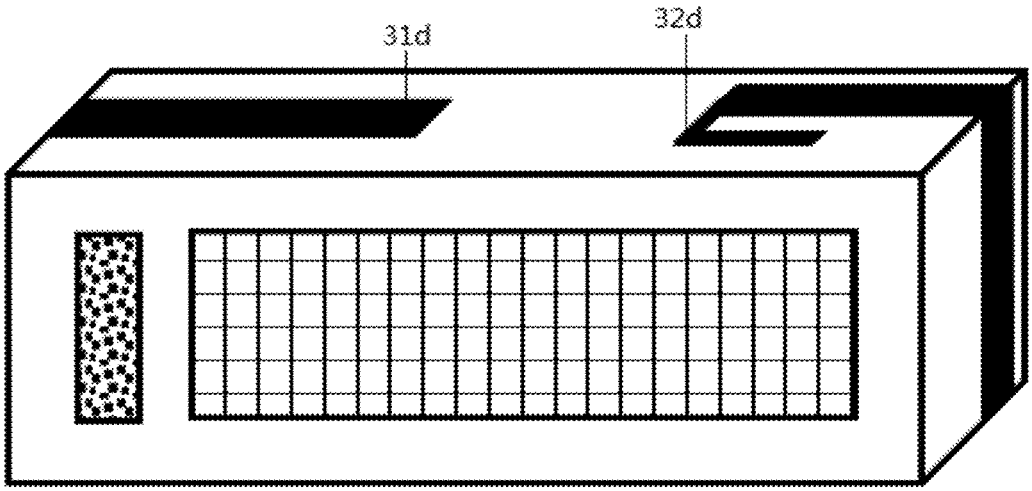
FIG. 10 is a three-dimensional structural schematic diagram of Example Four of the present invention at another perspective.

Referring to FIGS. 9 and 10, this example provides an integration module of millimeter-wave and non-millimeter-wave antennas, the composition and structural configuration of which are basically the same as those in Example One, except that the two non-millimeter-wave antennas (31*d*, 32*d*) included in this integration module are two non-millimeter-wave antennas of different forms, and the total length of the branches of the two non-millimeter-wave antennas (31*d*, 32*d*) is ¼ of the equivalent guided wave wavelength corresponding to their respective operating frequency.

The integration module of millimeter-wave and non-millimeter-wave antennas provided in this example has the same technical effect as that in Example One.

Example Five

Figure 11:
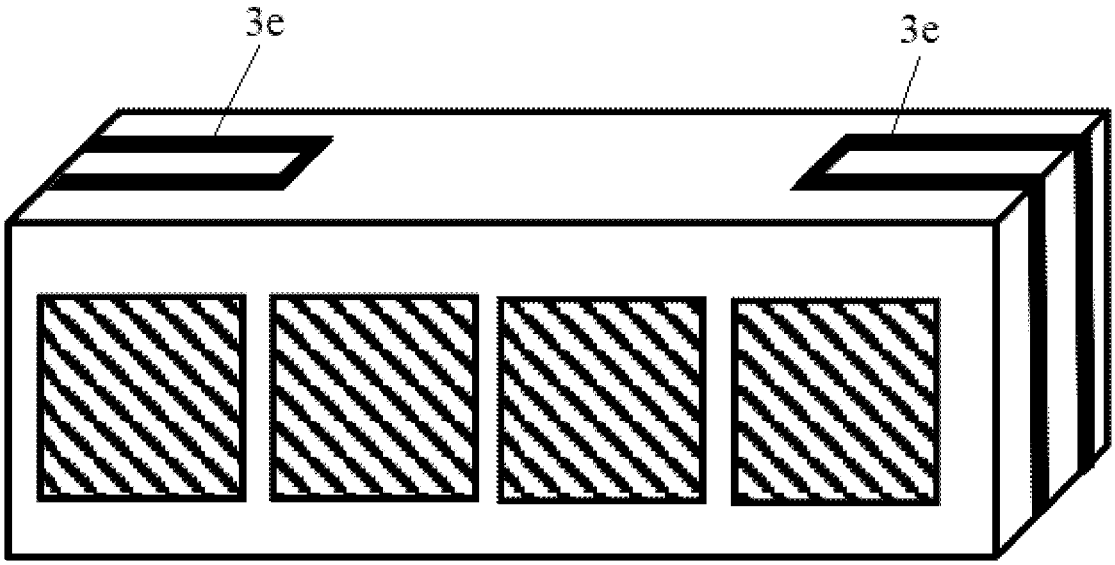
FIG. 11 is a three-dimensional structural schematic diagram of Example Five of the present invention.
Figure 12:
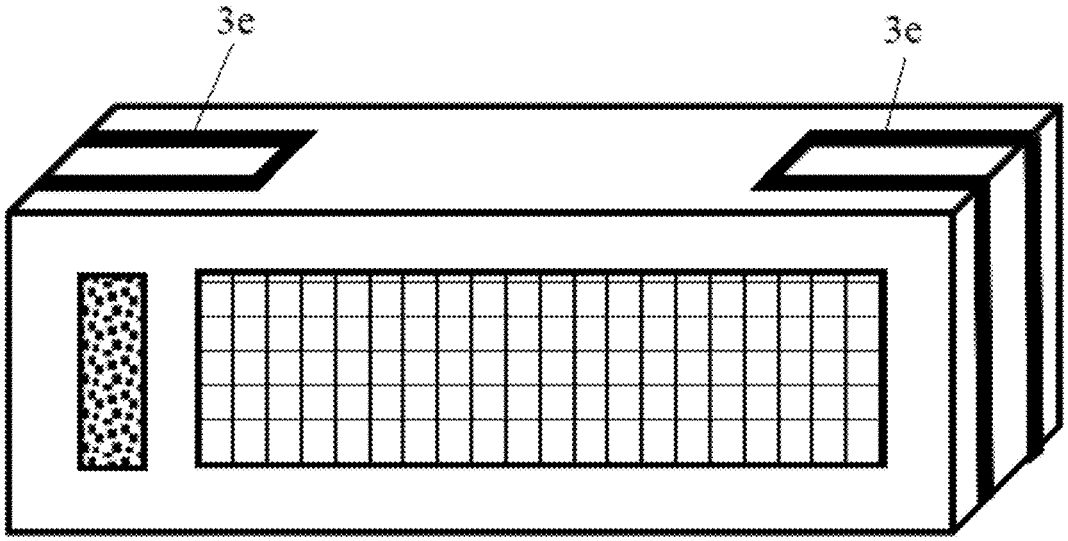
FIG. 12 is a three-dimensional structural schematic diagram of Example Five of the present invention at another perspective.
Figure 13:
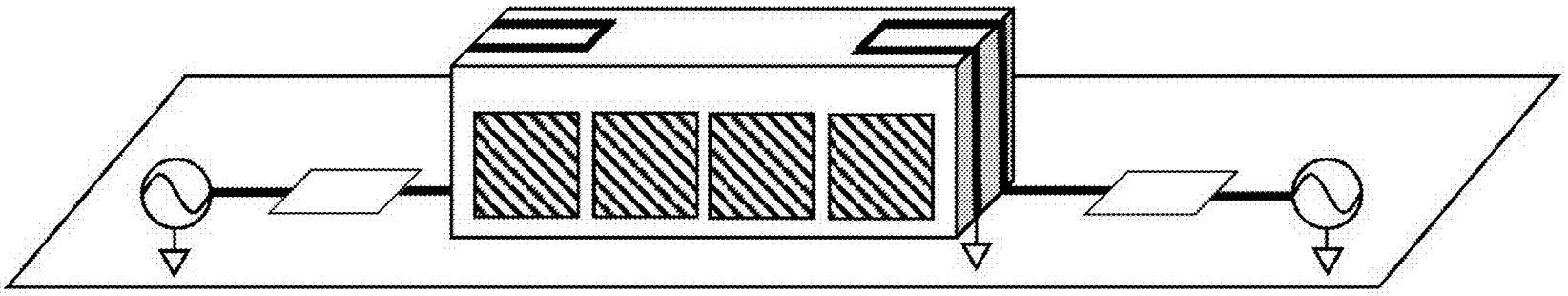
FIG. 13 is a structural schematic diagram of a system setting of Example Five of the present invention.
Figure 14:
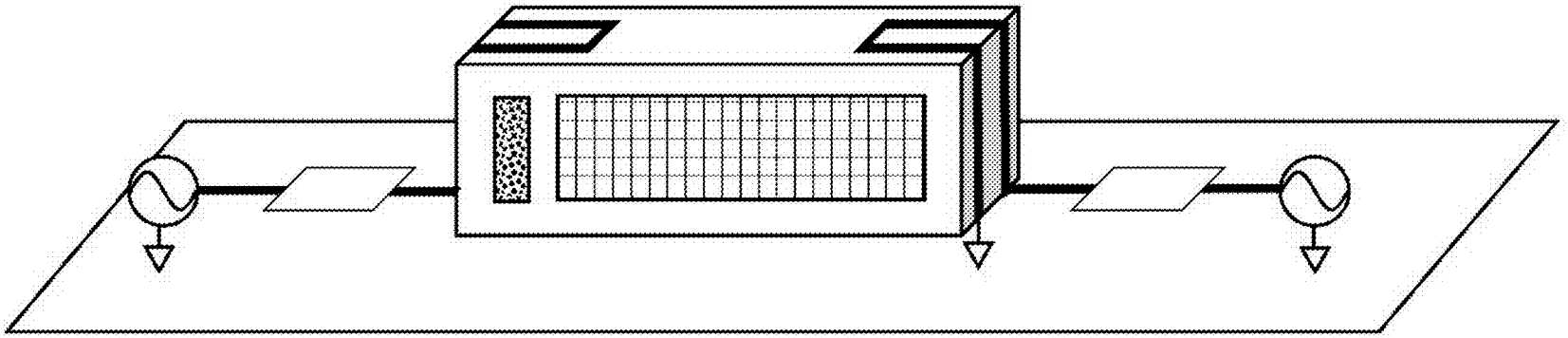
FIG. 14 is a view of FIG. 13 at another perspective.

Referring to FIGS. 11 and 12, this example provides an integration module of millimeter-wave and non-millimeter-wave antennas, the composition and structural configuration of which are basically the same as those in Example One, except that the two non-millimeter-wave antennas 3*e* included in this integration module are two loop antennas of the same form, the total length of each of non-millimeter-wave antennas 3*a* is preferably ½ of the equivalent guided wave wavelength corresponding to its operating frequency; its application state is shown in FIGS. 13 and 14.

The integration module of millimeter-wave and non-millimeter-wave antennas provided in this example has the same technical effect as that in Example One.

Example Six

Figure 15:
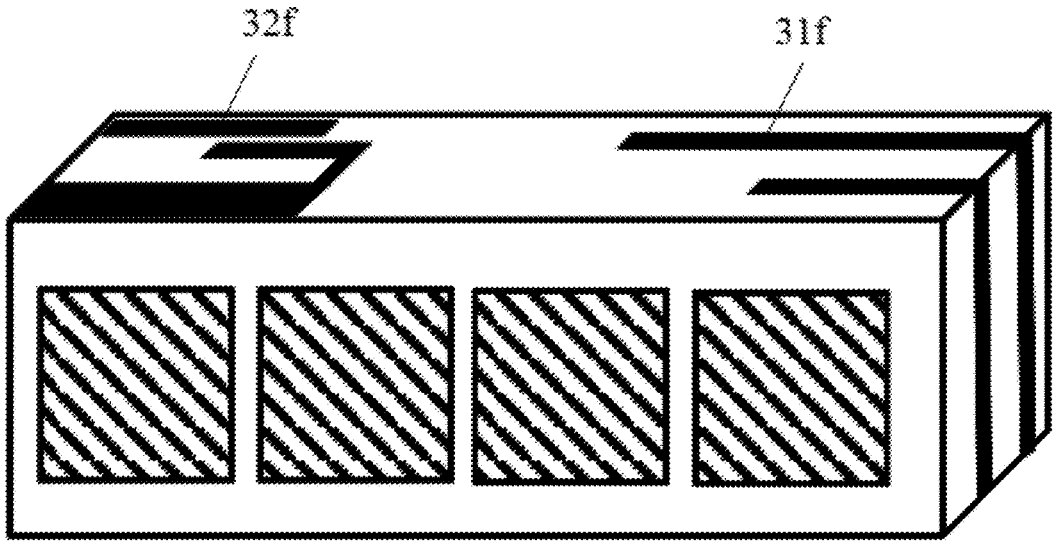
FIG. 15 is a three-dimensional structural schematic diagram of Example Six of the present invention.
Figure 16:
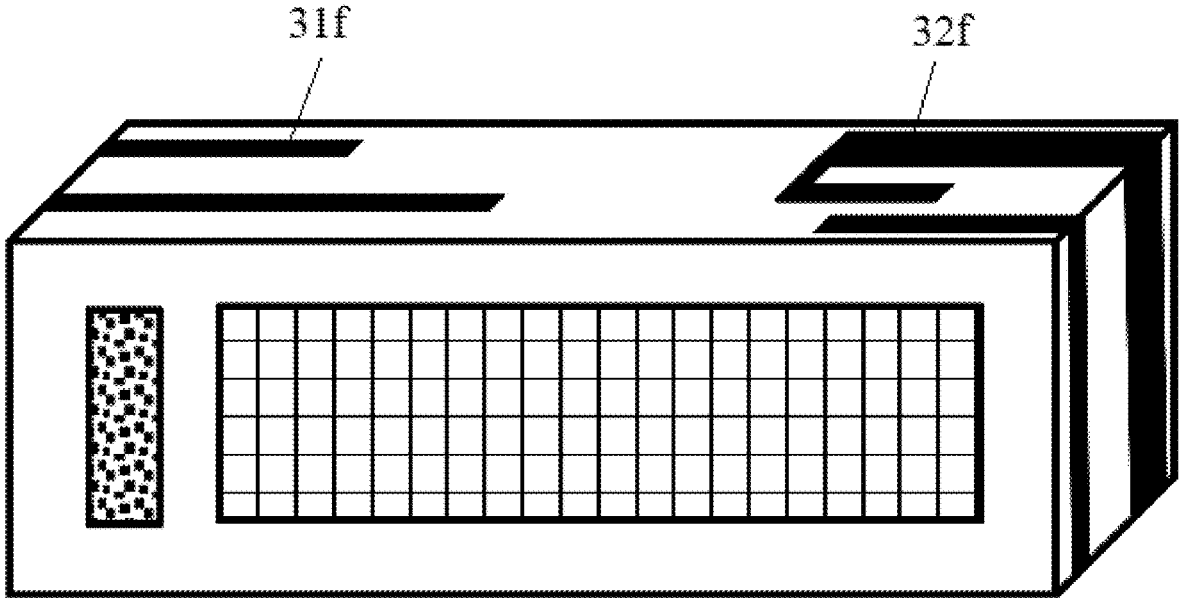
FIG. 16 is a three-dimensional structural schematic diagram of Example Six of the present invention at another perspective.
Figure 17:
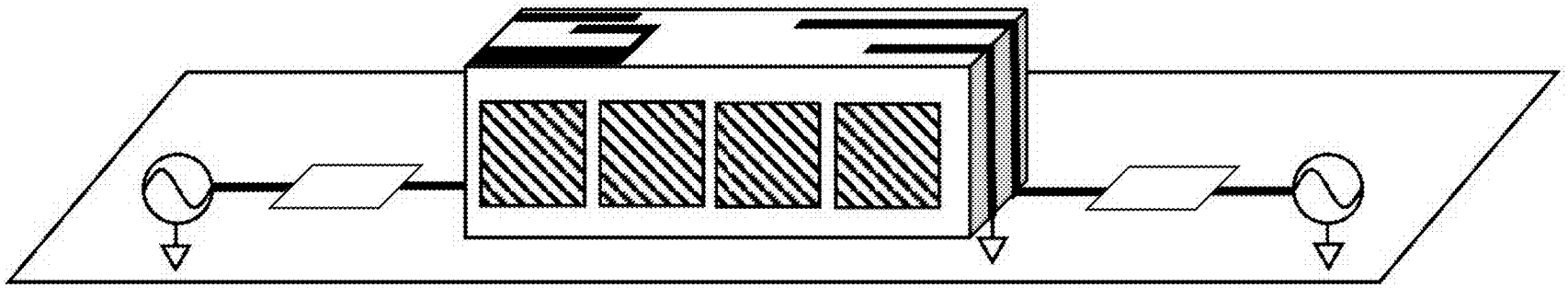
FIG. 17 is a structural schematic diagram of a system setting of Example Six of the present invention.
Figure 18:
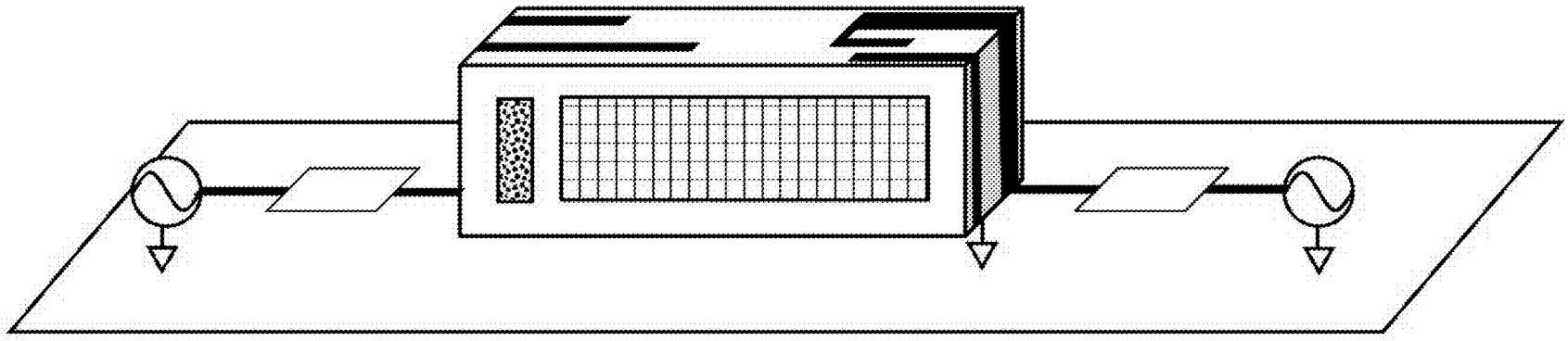
FIG. 18 is a view of FIG. 13 at another perspective.

Referring to FIGS. 15 and 16, this example provides an integration module of millimeter-wave and non-millimeter-wave antennas, the composition and structural configuration of which are basically the same as those in Example Five, except that the two non-millimeter-wave antennas (31*f*, 32*f*) included in this integration module are two antennas of different forms; its application state is shown in FIGS. 17 and 18.

The integration module of millimeter-wave and non-millimeter-wave antennas provided in this example has the same technical effect as that in Example Five.

Example Seven

Figure 19:
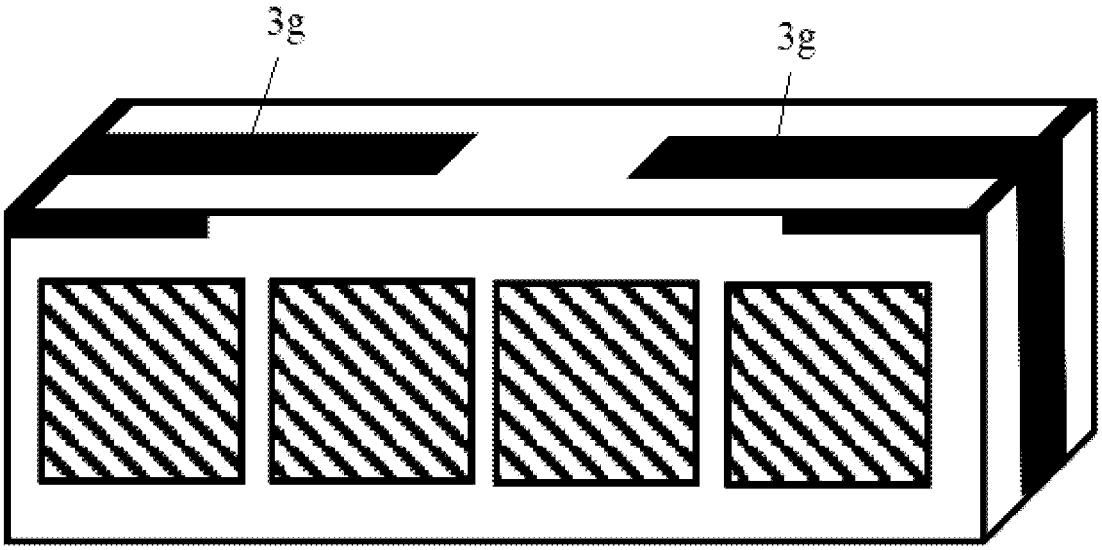
FIG. 19 is a three-dimensional structural schematic diagram of Example Seven of the present invention.
Figure 20:
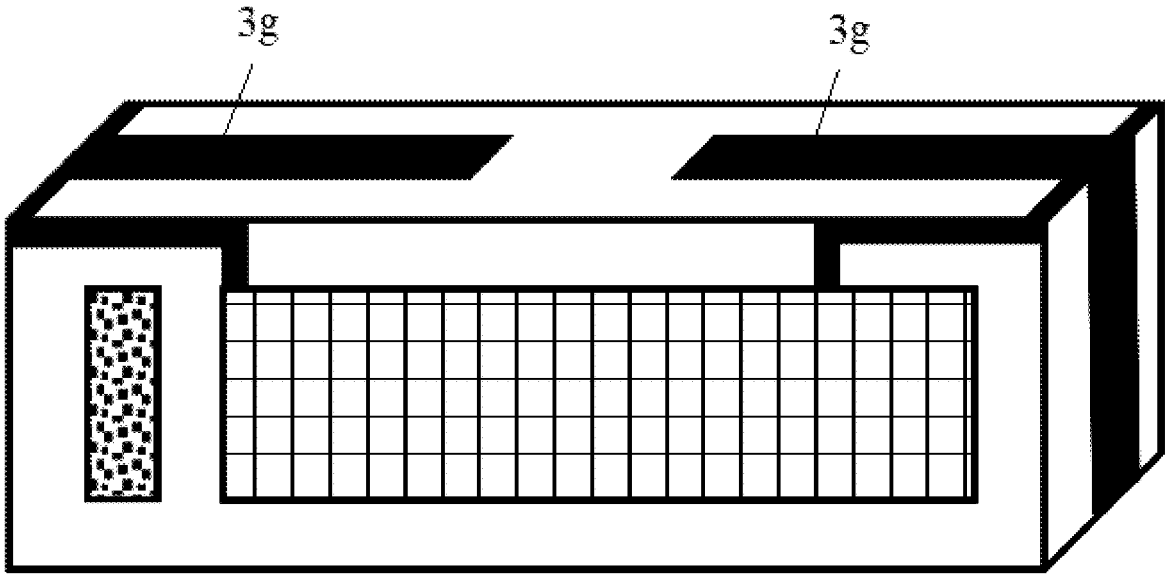
FIG. 20 is a three-dimensional structural schematic diagram of Example Seven of the present invention at another perspective.

Referring to FIGS. 19 and 20, this example provides an integration module of millimeter-wave and non-millimeter-wave antennas, the composition and structural configuration of which are basically the same as those in Example One, except that the two non-millimeter-wave antennas 3*g* included in this integration module are further connected to the ground layer on the module carrier.

The integration module of millimeter-wave and non-millimeter-wave antennas provided in this example has the same technical effect as that in Example Five.

Example Eight

Figure 21:
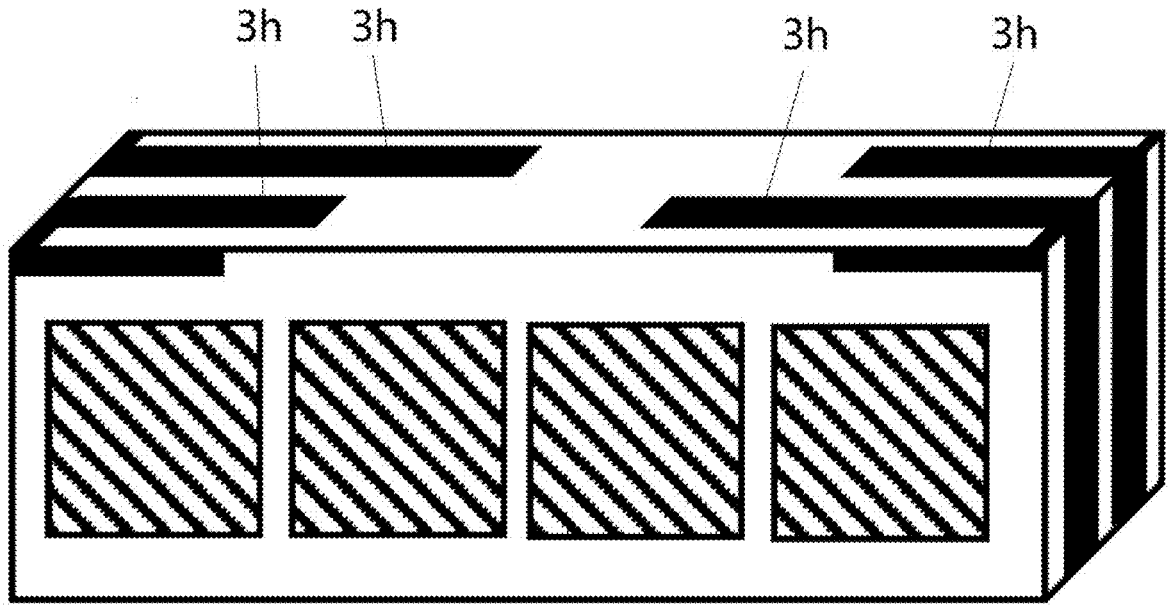
FIG. 21 is a three-dimensional structural schematic diagram of Example Eight of the present invention.
Figure 22:
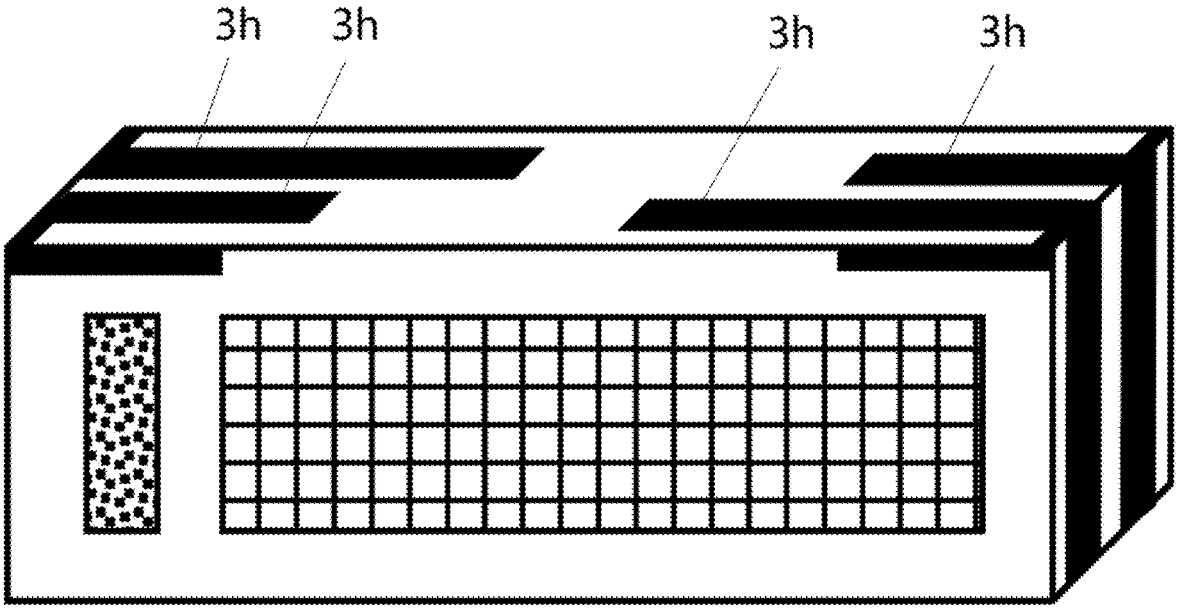
FIG. 22 is a three-dimensional structural schematic diagram of Example Eight of the present invention at another perspective.
Figure 23:
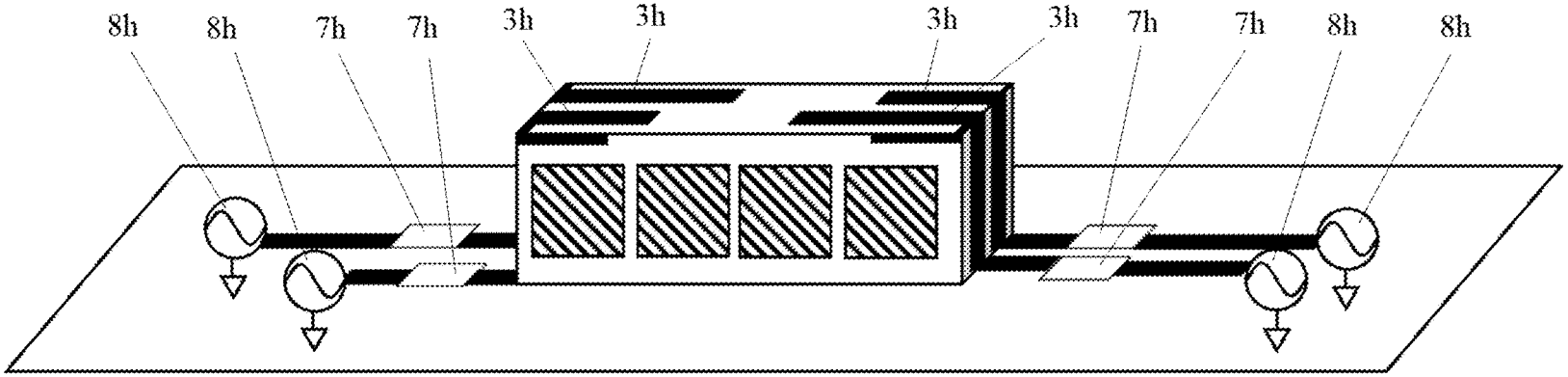
FIG. 23 is a structural schematic diagram of a system setting of Example Eight of the present invention.
Figure 24:
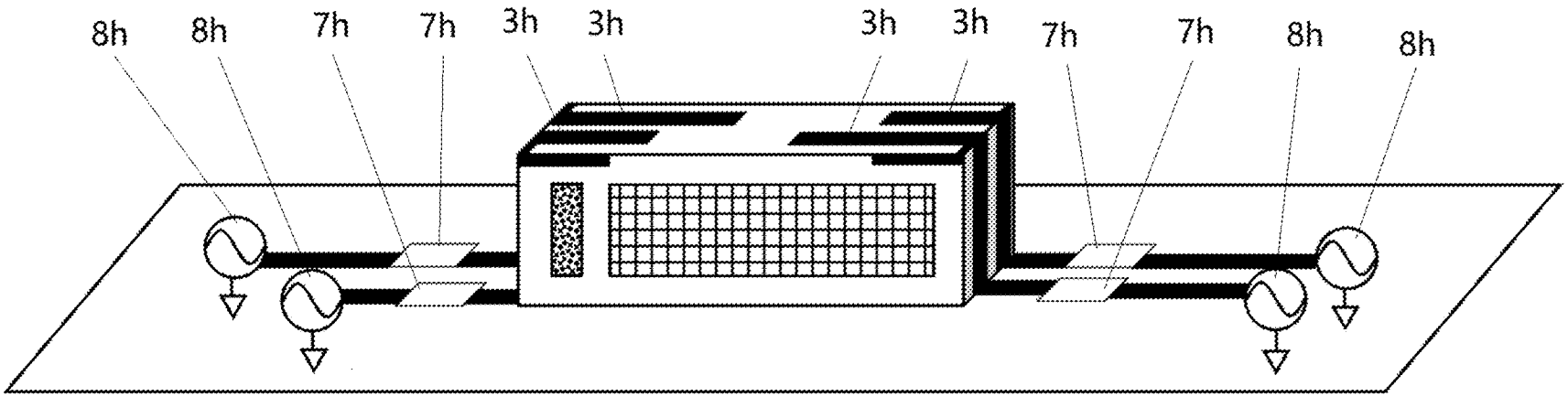
FIG. 24 is a view of FIG. 23 at another perspective.

Referring to FIGS. 21 and 22, this example provides an integration module of millimeter-wave and non-millimeter-wave antennas, the composition and structural configuration of which are basically the same as those in Example Two, except that the number of the non-millimeter-wave antennas 3*h* is four, two of which are provided on the short side vertical face, upper top face, and front long side vertical face of the module carrier, and the other two are provided on the short side vertical face, upper top face, and rear long side vertical face of the module carrier; referring to FIGS. 23 and 24, when applied, each of the non-millimeter-wave antennas 3*h* is connected to a non-millimeter-wave antenna matching network 7*h* and a non-millimeter-wave antenna feeding source 8*h*.

The integration module of millimeter-wave and non-millimeter-wave antennas provided in this example not only has the same technical effect as that in Example Two, but also can achieve the function of accommodating more non-millimeter-wave antennas.

Example Nine

Figure 25:
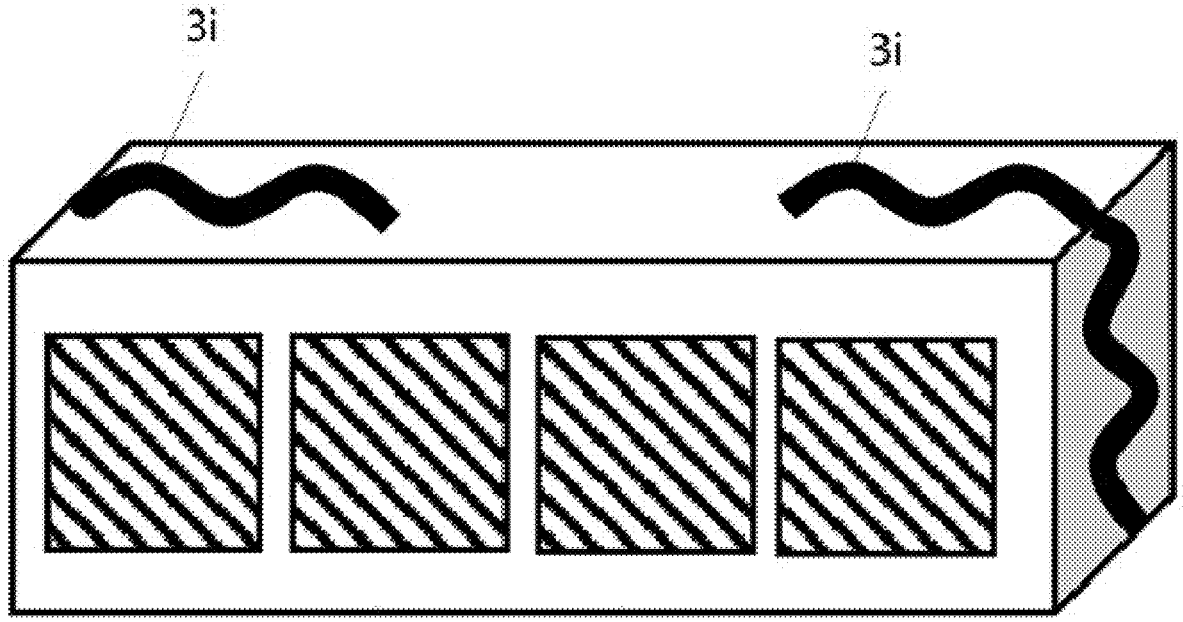
FIG. 25 is a three-dimensional structural schematic diagram of Example Nine of the present invention.
Figure 26:
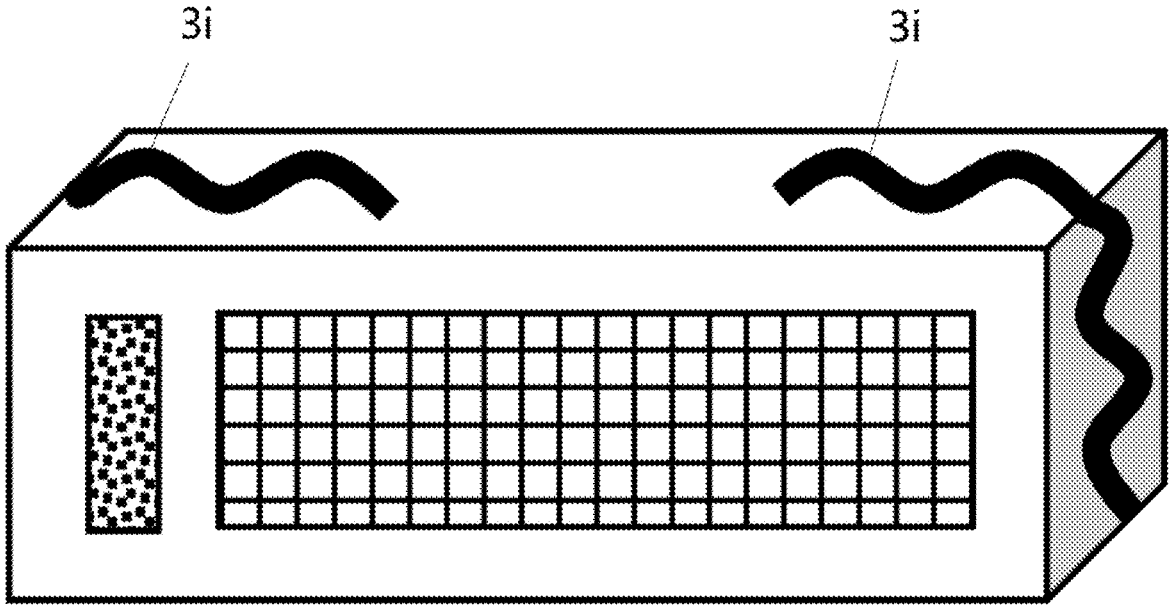
FIG. 26 is a three-dimensional structural schematic diagram of Example Nine of the present invention at another perspective.

Referring to FIGS. 25 and 26, this example provides an integration module of millimeter-wave and non-millimeter-wave antennas, the composition and structural configuration of which are basically the same as those in Example One, except that the two non-millimeter-wave antennas 3*i* included in this integration module are curved type.

The integration module of millimeter-wave and non-millimeter-wave antennas provided in this example has the same technical effect as that in Example Two.

The above description is only the preferred examples of the present invention, and therefore do not limit the scope of the present invention. Under the inventive concept of the present invention, equivalent structural transformations made by using the contents of the description and drawings of the present invention or the direct/indirect application of the present invention in other related technical fields fall within the scope of the present invention.

What is claimed is:

1. An integration module of millimeter-wave and non-millimeter-wave antennas, characterized by comprising a module carrier, one or more millimeter-wave antennas, one or more non-millimeter-wave antennas, and a radio frequency integrated circuit; the radio frequency integrated circuit is electrically connected to the millimeter-wave antenna(s); the radio frequency integrated circuit and the non-millimeter-wave antenna(s) are set in the same plane as or in a space non-parallel with that of the module carrier, wherein the module carrier comprises a first side, a second side and a third side respectively connected with two opposite ends of the first side, and a top side connected to the first side, the second side and the third side; the one or more millimeter-wave antennas is arranged on the first side, the one or more non-millimeter-wave antennas comprise a first non-millimeter-wave antenna arranged on the second side and the top side and extends from the second side to the top side.

2. The integration module of millimeter-wave and non-millimeter-wave antennas according to claim 1, characterized in that each millimeter-wave antenna can be in the form of any one of single linear polarization, dual linear polarization, single circular polarization, or dual circular polarization antenna working in a single band or multiple bands.

3. The integration module of millimeter-wave and non-millimeter-wave antennas according to claim 2, characterized in that the number of the millimeter-wave antenna(s) is multiple, forming one or more millimeter-wave antenna arrays; and each of said millimeter-wave antenna array is any one of a linear array, a square array, a rectangular array, a triangular array, a circular array, and a non-equidistant array.

4. The integration module of millimeter-wave and non-millimeter-wave antennas according to claim 3, characterized in that the number of the millimeter-wave antenna array is one, and the millimeter-wave antenna array is a one-dimensional linear array, and the size of each millimeter-wave antenna unit is less than or equal to 2 equivalent guided wavelengths at its the lowest operating frequency; the spacing between two adjacent millimeter-wave antennas is less than or equal to 2 free-space wavelengths at its lowest operating frequency.

5. The integration module of millimeter-wave and non-millimeter-wave antennas according to claim 1, characterized in that each non-millimeter-wave antenna is in the form of any one of a monopole antenna, a dipole antenna, patch antenna, stacked patch antenna, inverted F antenna (IFA), planar inverted F antenna (PIFA), Yagi-Uda antenna, slot antenna, magnetic-electric dipole antenna, horn antenna, loop antenna, grid antenna, cavity-backed antenna and leaky-wave antenna.

6. The integration module of millimeter-wave and non-millimeter-wave antennas according to claim 1, characterized in that the number of non-millimeter-wave antenna(s) is two, and the total length of each non-millimeter-wave antenna 3*a* is ¼ of the equivalent guided wavelength corresponding to its operating frequency; the spacing between two non-millimeter-wave antennas 3*a* is greater than 0.01 free-space wavelength at their lowest operating frequency.

7. The integration module of millimeter-wave and non-millimeter-wave antennas according to claim 1, characterized by further comprising other chips, which are selected from any one or more of a power management chip, an arithmetic processing chip, and a data storage chip.

8. The integration module for millimeter-wave and non-millimeter-wave antennas according to claim 1, wherein the module carrier is provided with a ground layer, and the non-millimeter-wave antenna(s) is connected to the ground layer.

9. The integration module of millimeter-wave and non-millimeter-wave antennas according to claim 1, characterized in that:

the shape of the module carrier can be any one of square, rectangle, triangle, trapezoid, C-shape, E-shape, F-shape, L-shape, T-shape, V-shape, U-shape, W-shape, X-shape, Y-shape, Z-shape, "concave" shape, "convex" shape, "mouth" shape, "one square encircled by another bigger one" shape, round, ellipse and arc.

10. The integration module of millimeter-wave and non-millimeter-wave antennas according to claim 1, characterized in that the material of the module carrier is any one of low-temperature co-fired ceramic (LTCC), high-temperature co-fired ceramic (HTCC), ceramic, printed circuit board (PCB), flexible printed circuit (FPC), modified PI (MPI), liquid crystal polymer (LCP) and fluorine-containing material.

11. The integration module of millimeter-wave and non-millimeter-wave antennas according to claim 1, wherein the first non-millimeter-wave antenna comprises a branch extending from the top side to the first side.

12. The integration module of millimeter-wave and non-millimeter-wave antennas according to claim 1, wherein the module carrier comprises a fourth side away from the first side, and the radio frequency integrated circuit is arranged on the fourth side.

13. The integration module of millimeter-wave and non-millimeter-wave antennas according to claim 1, wherein the module carrier comprises a fourth side away from the first side, the first non-millimeter-wave antenna comprises a branch extending from the top side to the fourth side.

14. The integration module of millimeter-wave and non-millimeter-wave antennas according to claim 1, wherein the one or more non-millimeter-wave antennas comprise a second non-millimeter-wave antenna arranged on the third side and the top side and extends from the third side to the top side.

15. The integration module of millimeter-wave and non-millimeter-wave antennas according to claim 1, the second non-millimeter-wave antenna is in a different form with the first non-millimeter-wave antenna.

16. The integration module of millimeter-wave and non-millimeter-wave antennas according to claim 1, wherein the first non-millimeter-wave antenna or the second non-millimeter-wave antenna is curve shaped.

17. The integration module of millimeter-wave and non-millimeter-wave antennas according to claim 1, wherein each of the first non-millimeter-wave antenna and the second non-millimeter-wave antenna is connected to a non-millimeter-wave antenna matching network and a non-millimeter-wave antenna feeding source.

* * * * *